US005174095A

United States Patent [19]

Fujiwara et al.

[11] Patent Number: 5,174,095

[45] Date of Patent: Dec. 29, 1992

[54] METHOD AND APPARATUS FOR PACKAGING A ROLLED WEB

[75] Inventors: Takayuki Fujiwara; Shigehisa Shimizu; Hisashi Takahashi; Satoshi Mino, all of Kanagawa, Japan

[73] Assignee: Fuji Photo Film Co., Ltd., Kanagawa, Japan

[21] Appl. No.: 787,607

[22] Filed: Nov. 4, 1991

[30] Foreign Application Priority Data

Nov. 2, 1990 [JP] Japan ..... 2-298358

[51] Int. Cl.[5] ..... B65B 49/12

[52] U.S. Cl. ..... 53/480; 53/465; 53/372.9; 53/211

[58] Field of Search ..... 53/372.8, 372.9, 211, 53/284, 480, 465

[56] References Cited

U.S. PATENT DOCUMENTS

| | | | |
|---|---|---|---|
| 914,578 | 3/1909 | Johnston | 53/372.9 |
| 2,246,525 | 6/1941 | Matter | 53/372.9 |
| 2,643,499 | 6/1953 | Gerlach | 53/372.9 |
| 2,803,935 | 8/1957 | Gibson | 53/372.9 |
| 3,063,214 | 11/1962 | Ellman | 53/372.9 |
| 3,330,095 | 7/1967 | Sandberg | 53/372.9 |
| 4,845,919 | 7/1989 | Fujii | 53/372.9 |

FOREIGN PATENT DOCUMENTS

| | | |
|---|---|---|
| 58-134824 | 8/1983 | Japan . |
| 58-134825 | 8/1983 | Japan . |
| 63-44415 | 2/1988 | Japan . |

*Primary Examiner*—John Sipos

*Attorney, Agent, or Firm*—Sughrue, Mion, Zinn, Macpeak & Seas

[57] ABSTRACT

In a method and apparatus for packaging a rolled web, a feed roller is located near each of opposed end faces of the rolled web to be packaged. The axis of rotation of a feed roller is inclined with respect to the radial direction of the roll, which radial direction intersects perpendicularly to the direction along which a wrapping material having side edge parts folded in L-shapes is fed, such that the outer periphery of the axis of rotation, which outer periphery is taken in the radial direction of the roll, is more forward with respect to the direction, along which the wrapping material is fed, than the inner periphery of the axis of rotation. A folding member is located on the side more forward than the feed roller with respect to the direction, along which the wrapping material is fed. The folding member is supported such that the space between the folding member and the opposed end faces of the roll varies periodically. The feed roller rotates to feed the side edge part of the wrapping material while the side edge part is being imparted with tension towards the center of rotation of the roll. A slack portion of the side edge part of the wrapping material, which slack portion occurs on the side forward from the feed roller with respect to the direction, along which the wrapping material is fed, is folded by the folding member at predetermined intervals onto the opposed end faces of the roll.

6 Claims, 6 Drawing Sheets

METHOD AND APPARATUS FOR PACKAGING A ROLLED WEB

BACKGROUND OF THE INVENTION

1. Field of the Invention

This invention relates to a method for packaging a rolled web, wherein a wrapping material is wound around the outer circumferential portion of the rolled web which is to be packaged, and side edge parts of the wrapping material are folded onto opposed end faces of the rolled web which is to be packaged.

2. Description of the Prior Art

Methods for packaging a rolled web have heretofore been carried out wherein a wrapping material is wound around the outer circumferential portion of a rolled web which is to be packaged, and side edge parts of the wrapping material are folded in a chrysanthemum-like pattern onto outer end faces of the rolled web which is to be packaged. In general, such a method for packaging a rolled web is carried out with a mechanism Shown in FIGS. 6A and 6B. Specifically, as illustrated in FIG. 6A, a wrapping material 4, the width of which is larger than the width of a rolled web 2 to be packaged, is wound around the outer circumferential portion of the rolled web 2 to be packaged such that side edge parts 4*a*, 4*a* of the wrapping material 4 project beyond opposed end faces of the rolled web 2 to be packaged. Thereafter, as illustrated in FIG. 6B, each of the side edge parts 4*a*, 4*a* of the wrapping material 4, which project in cylindrical shapes outwardly from the opposed end faces of the rolled web 2 to be packaged, is folded by rotating the folding tools 10, 10, . . . centripetally from the side of the outer circumference of the side edge part 4*a*. The folds, which have thus been formed, are then pressed in the circumferential direction.

However, the aforesaid method for packaging a rolled web has the drawbacks described below.

(1) A number of folding tools must be used, which number is equal to the number of the folds, and therefore the packaging machine cannot be kept simple and cheap.

(2) The side edge parts of the wrapping material, which project in cylindrical shapes outwardly from the opposed end faces of the rolled web to be packaged, fall by gravity, and therefore appropriate folding operations cannot be carried out.

(3) The method for packaging a rolled web has little flexibility with respect to a change in the diameter of the rolled web to be packaged.

In order for the aforesaid drawbacks to be eliminated, novel methods for packaging a rolled web have been proposed in Japanese Unexamined Patent Publication Nos. 58(1983)-134824 and 58(1983)-134825. As illustrated in FIG. 7, with the proposed methods for packaging a rolled web, a wrapping material 4 having side edge parts 4*a*, 4*a* is used (only one of the side edge parts 4*a*, 4*a* is shown). Each side edge part 4*a* is folded into an L-shape from the middle part of the wrapping material 4. A leading edge part of the wrapping material 4 is brought onto part of the outer circumferential portion of the rolled web 2 to be packaged such that the bend corners of the wrapping material 4 are located at the opposed end faces of the outer circumferential portion of the rolled web 2 to be packaged. Thereafter, the rolled web 2 to be packaged is rotated such that the wrapping material 4 may be fed forwardly. In this manner, the wrapping material 4 is wound around the outer circumferential portion of the rolled web 2 to be packaged. A feed roller 20 and a folding roller 22 are located in the vicinity of each of the opposed end faces of the rolled web 2 to be packaged. When the wrapping material 4 is wound around the outer circumferential portion of the rolled web 2 to be packaged, each side edge part 4*a* is folded onto the opposed faces of the rolled web 2 to be packaged. In this manner, a plurality of folds of the side edge part 4*a* are formed one after another on each opposed end faces of the rolled web 2 to be packaged. Specifically, as illustrated in FIG. 7, with the proposed methods for packaging a rolled web, the feed roller 20 is rotated around an axis of rotation, which intersects perpendicularly to the direction along which the wrapping material 4 is fed. Also, the folding roller 22 is located on the side more forward than the feed roller 20 with respect to the direction along which the wrapping material 4 is fed. A slack portion, which occurs in the side edge part 4*a* having passed over the feed roller 20, is folded by the folding roller 22 onto the opposed end faces of the rolled web 2 to be packaged.

The methods for packaging a rolled web, which have been proposed in the aforesaid publications, can eliminate the drawbacks of the method for packaging a rolled web, which is illustrated in FIG. 6. However, the proposed methods for packaging a rolled web have the problems described below.

(1) The feed roller 20 is rotated around the axis of rotation, which intersects perpendicularly to the direction along which the wrapping material 4 is fed. Therefore, when the side edge part 4*a*, which has passed over the feed roller 20, is fed to the folding roller 22, the side edge part 4*a* has a velocity in the tangential direction of the rolled web 2 to be packaged. Accordingly, the wrapping material 4 cannot be folded appropriately by the folding roller 22 but becomes pushed outwardly in the radial direction of the rolled web 2 to be packaged (the outward direction is indicated by the arrow A in FIG. 7). Particularly, as shown in FIG. 7, with the method for packaging a rolled web, which has been proposed in Japanese Unexamined Patent Publication No. 58(1983)-134825, such that radial folds shown in FIG. 4B may be obtained, the axis of rotation of the folding roller 22 is inclined at a predetermined angle $\delta$ from the radial direction of the rolled web 2 to be packaged. In such cases, the wrapping material 4 markedly becomes pushed outwardly in the radial direction of the rolled web 2 to be packaged.

(2) Of the wrapping material 4, which has been folded onto the opposed end faces of the rolled web 2 to be packaged, the part forming a fold becomes thicker than the other part. Therefore, the part forming a fold cannot pass smoothly over the folding roller 22. As a result, a lag occurs with the formation of folds.

(3) The slack portion of the side edge part 4*a*, which portion has occurred between the feed roller 20 and the folding roller 22, cannot pass smoothly over the folding roller 22. Therefore, the sizes of the resulting folds and the intervals between the resulting folds fluctuate markedly.

In order to overcome the two problems described last to be eliminated, Japanese Unexamined Patent Publication No. 63(1988)-44415 discloses a means for forcibly passing the slack portion of the side edge part 4*a* over the folding roller 22. However, when such a means is employed, the folding speed cannot be kept high. Also, there is the risk that the wrapping material 4 is broken or damaged.

SUMMARY OF THE INVENTION

The primary object of the present invention is to provide a method for packaging a rolled web, wherein a wrapping material is prevented from being pushed outwardly in the radial direction of a rolled web to be packaged, and side edge parts of the wrapping material can be folded accurately.

Another object of the present invention is to provide a method for packaging a rolled web, wherein folds of side edge parts of a wrapping material can be formed regularly such that no lag may occur with the formation of the folds and no fluctuation may occur with the sizes of the folds and the intervals between the folds.

A further object of the present invention is to provide a method for packaging a rolled web, wherein folds of side edge parts of a wrapping material can be formed regularly such that the folding speed may be kept high and the wrapping material may not be broken or damaged.

The specific object of the present invention is to provide an apparatus for carrying out the method for packaging a rolled web.

The objects of the present invention are accomplished by inclining the axis of rotation of a feed roller at a predetermined angle, and thereby feeding a side edge part of a wrapping material while the side edge part is being imparted with tension towards the center of rotation of a rolled web to be packaged. Also, in lieu of the conventional folding roller constituted such that the space between the folding roller and the opposed end faces of a rolled web to be packaged is fixed, a folding member is employed to fold the side edge part of the wrapping material, the folding member being constituted such that the space between the folding member and the opposed end faces of the roll to be packaged varies periodically.

Specifically, the present invention provides a method for packaging a rolled web, wherein a leading part of a wrapping material having side edge parts, each of which has been folded into an L-shaped from the middle part of the wrapping material, is brought onto part of the outer circumferential portion of a rolled web, which is to be packaged, such that the bend corners of the wrapping material are located at opposed end faces of the outer circumferential portion of the roll to be packaged, and thereafter the roll to be packaged is rotated such that the wrapping material may be fed forwardly, whereby the wrapping material is wound around the outer circumferential portion of the roll to be packaged, wherein the improvement comprises the steps of:

i) locating a feed roller in the vicinity of each of opposed end faces of said roll, which is to be packaged, the axis of rotation of said feed roller being inclined with respect to the radial direction of said roll to be packaged, which radial direction intersects perpendicularly to the direction along which said wrapping material is fed, such that the outer periphery of said axis of rotation, which outer periphery is taken in said radial direction of said roll to be packaged, is more forward with respect to the direction, along with said wrapping material is fed, than the inner periphery of said axis of rotation, which inner periphery is taken in said radial direction of said roll to be packaged, ii) locating a folding member on the side more forward than said feed roller with respect to the direction, along which said wrapping material is fed, said folding member being supported such that the space between said folding member and the opposed end faces of said roll to be packaged varies periodically, iii) rotating said feed roller while it is being in contact with the side edge part of said wrapping material, said side edge part of said wrapping material being thereby fed while said side edge part is being imparted with tension towards the center of rotation of said roll to be packaged, and iv) folding a slack portion of said side edge part of said wrapping material, which slack portion occurs on the side forward from said feed roller with respect to the direction, along which wrapping material is fed, by said folding member at predetermined intervals onto said opposed end faces of said roll to be packaged.

The present invention also provides an apparatus for packaging a rolled web, wherein a leading part of a wrapping material having side edge parts, each of which has been folded into an L-shape from the middle part of the wrapping material, is brought onto part of the outer circumferential portion of a rolled web, which is to be packaged , such that the bend corners of the wrapping material are located at side edges of the outer circumferential portion of the roll to be packaged, and thereafter the roll to be packaged is rotated such that the wrapping material may be fed forwardly, whereby the wrapping material is wound around the outer circumferential portion of the roll to be packaged, wherein the improvement comprises the provision of:

i) a feed roller located in the vicinity of each of opposed end faces of said roll, which is to be packaged, the axis of rotation of said feed roller being inclined with respect to the radial direction of said roll to be packaged, which radial direction intersects perpendicularly to the direction along which said wrapping material is fed, such that the outer periphery of said axis of rotation, which outer periphery is taken in said radial direction of said roll to be packaged, is more forward with respect to the direction, along which said wrapping material is fed, than the inner periphery of said axis of rotation, which inner periphery is taken in said radial direction of said roll to be packaged, said feed roller being rotated while it is being in contact with the side edge part of said wrapping material, said side edge part of said wrapping material being thereby fed in the direction, along which said roll to be packaged rotates, while said side edge part is being imparted with tension towards the center of rotation of said roll to be packaged, and ii) a folding member located on the side more forward than said feed roller with respect to the direction, along which said wrapping material is fed, said folding member being supported such that the space between said folding member and the opposed end faces of said roll to be packaged varies periodically, a slack portion of said side edge part of said wrapping material, which slack portion occurs on the side forward from said feed roller with respect to the direction, along which said wrapping material is fed, being folded by said folding member at predetermined intervals onto said opposed end faces of said roll to be packaged.

With the method and apparatus for packaging a rolled web in accordance with the present invention, the feed roller is located in the vicinity of each of the opposed end faces of the roll, which is to be packaged.

The axis of rotation of the feed roller is inclined with respect to the radial direction of the roll to be packaged, which radial direction intersects perpendicularly to the direction along which the wrapping material is fed. Specifically, the axis of rotation of the feed roller is inclined such that the outer periphery of the axis of rotation, which outer periphery is taken in the radial direction of the roll to be packaged, is more forward with respect to the direction, along which the wrapping material is fed, than the inner periphery of the axis of rotation, which inner periphery is taken in the radial direction of the roll to be packaged. The feed roller is rotated while it is being in contact with the side edge part of the wrapping material. The side edge part of the wrapping material is thereby fed while the side edge part is being imparted with tension towards the center of rotation of the roll to be packaged. Therefore, the wrapping material can be prevented from being pushed outwardly in the radial direction of a rolled web to be packaged, and the side edge parts of the wrapping material can be folded accurately.

Also, with the method and apparatus for packaging a rolled web in accordance with the present invention, the folding member is located on the side more forward than the feed roller with respect to the direction, along which the wrapping material is fed. The folding member is supported such that the space between the folding member and the opposed end faces of the roll to be packaged varies periodically. The slack portion of the side edge part of the wrapping material, which slack portion occurs on the side forward from the feed roller with respect to the direction, along which the wrapping material is fed, is folded by the folding member at predetermined intervals onto the opposed end faces of the roll to be packaged. Therefore, no problem occurs in that, as in the conventional techniques, the side edge part of the wrapping material cannot smoothly pass over a folding roller and a lag thereby occurs with the formation of the folds . Additionally, the sizes of the folds and the intervals between the folds can be prevented from fluctuating. Accordingly, with the method and apparatus for packaging a rolled web in accordance with the present invention, folds of side edge parts of a wrapping material can be formed regularly such that the folding speed may kept high and the wrapping material may not be broken or damaged.

DESCRIPTION OF THE PREFERRED EMBODIMENTS

The present invention will hereinbelow be described in further detail with reference to the accompanying drawings.

Figure 1:
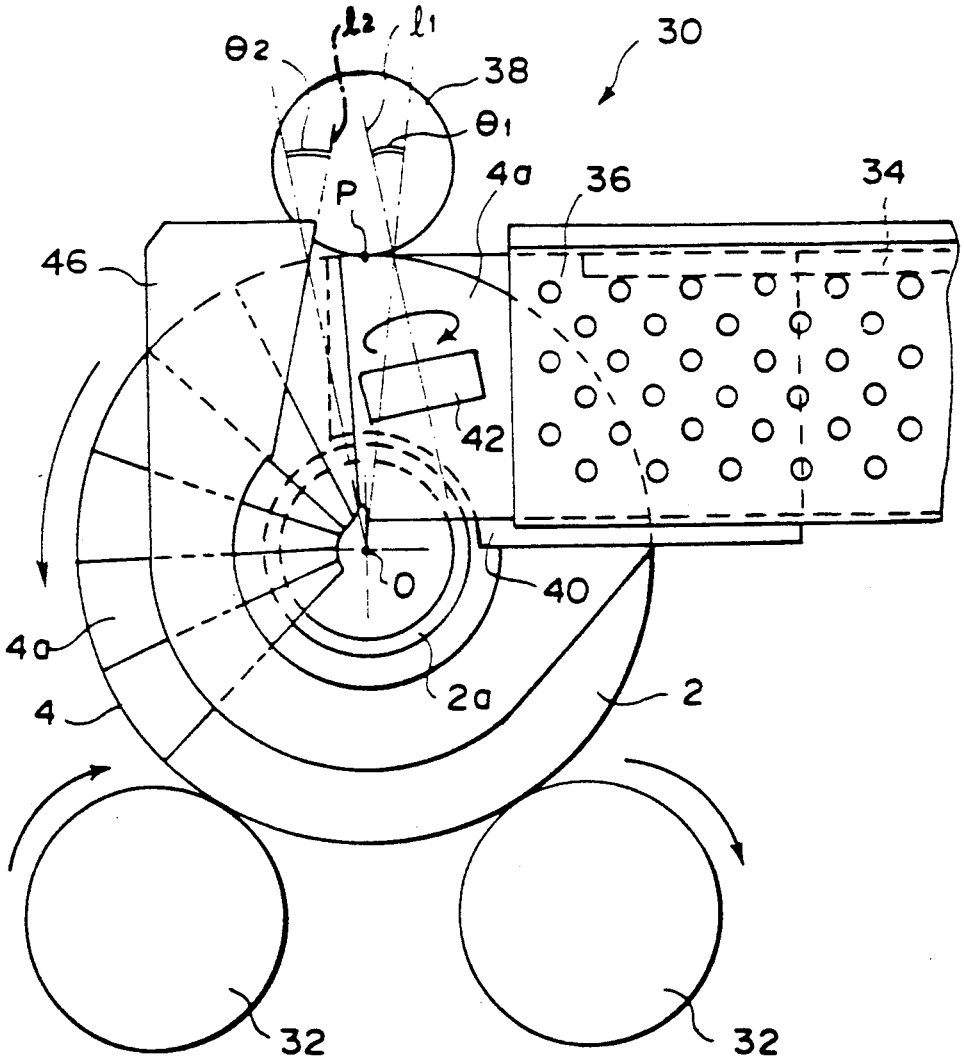
FIG. 1 is a side view showing an embodiment of the apparatus for packaging a rolled web in accordance with the present invention.
Figure 2:
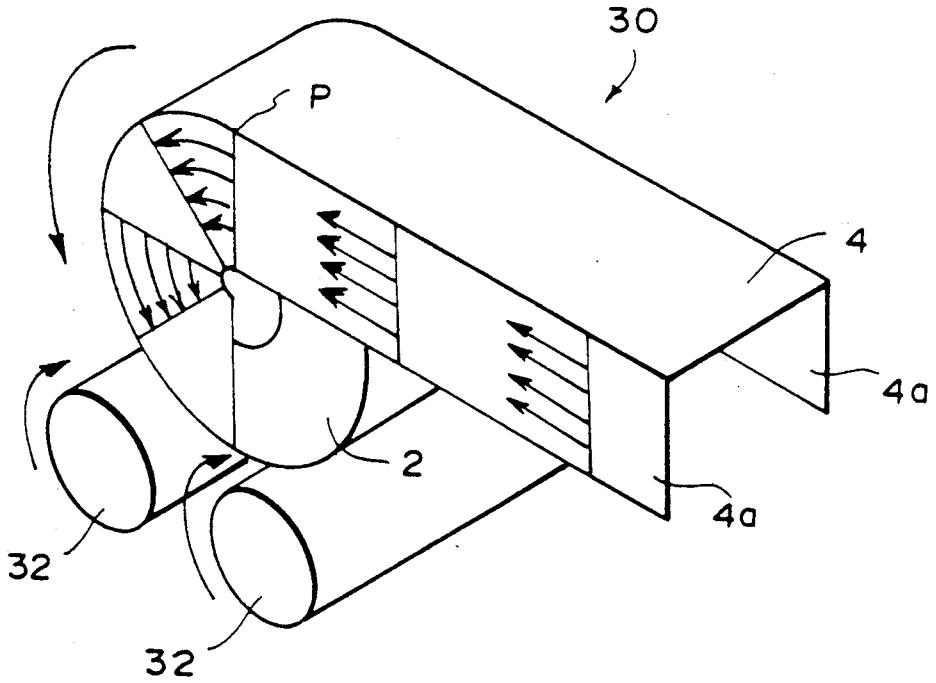
FIG. 2 is a perspective view showing the embodiment of FIG. 1, FIGS. 3A, 3B, and 3C are perspective views showing part of the embodiment of FIG. 1, FIGS. 4A and 4B are side views showing rolls, which have been packaged with the embodiment of FIG. 1.

FIG. 1 is a side view showing an embodiment of the apparatus for packaging a rolled web in accordance with the present invention. FIG. 2 is a perspective view showing the embodiment of FIG. 1.

With reference to FIG. 2, in an apparatus 30 for packaging a rolled web, a rolled web 2 to be packaged is placed on a pair of drive rollers 32, 32. Thereafter, a leading part of a wrapping material 4 is brought and secured to the top part of the outer circumferential portion of the rolled web 2 to be packaged. The wrapping material 4 has side edge parts **4*a*, 4*a*, each of which has been folded into an L-shape from the middle part of the wrapping material 4. The leading part of the wrapping material 4, the cross-section of which is thus in an inverted U-shape, is brought onto the top part of the outer circumferential portion of the rolled web 2, which is to be packaged, such that the bend corners of the wrapping material 4 are located at opposed end faces of the outer circumferential portion of the rolled web 2 to be packaged. Thereafter, the rolled web 2 to be packaged is rotated by the drive rollers 32, 32 such that the wrapping material 4 may be fed forwardly. In this manner, the wrapping material 4 is wound around the outer circumferential portion of the rolled web 2** to be packaged.

As illustrated in FIG. 1, the wrapping material 4 is supplied along a guide table 34. In cases where the wrapping material 4 is soft, the cross-section of the wrapping material 4 is kept in the inverted U-shape by a suction conveyor 36. A rider roller 38 is located such that it is in contact with the top part P of the outer circumferential portion of the rolled web 2 to, be packaged. When the wrapping material 4 is wound around the outer circumferential portion of the rolled web 2 to be packaged, the rider roller 38 presses the wrapping material 4 and thereby imparts it with back tension. In this embodiment, the wrapping material 4 is supplied from the horizontal direction, and the winding of the wrapping material 4 around the outer circumferential portion of the rolled web 2 to be packaged is begun at the point P in the top part of the outer circumferential portion of the rolled web 2 to be packaged. In such cases, the wrapping material 4 can be supplied while it is kept in the U-shape regardless of gravity.

A guide plate 40 is located at the leading part of the guide table 34. The guide plate 40 extends in parallel with the corresponding opposed end faces of the rolled web 2 to be packaged. The side edge part **4*a* of the wrapping material 4 is supplied along the guide plate 40 up to approximately the middle of the opposed end faces of the rolled web 2 to be packaged. Thereafter, the side edge part 4*a* of the wrapping material 4 is folded. The guide plate 40 prevents errors from occurring in the feeding of the wrapping material 4 when the direction, along which the wrapping material 4 is fed, and the direction, along which the rolled web 2 to be packaged is rotated, differ from each other. When the wrapping material 4 is wound two or three turns around the outer circumferential portion of the roll to be packaged, the guide plate 40** also prevents the folds, which have been formed during a previous turn, from adversely affecting the formation of new folds.

A feed roller 42 is located in the vicinity of part of the opposed end faces of the rolled web 2 to be packaged, at which part the guide plate 40 extends. The axis of rotation l1 of the feed roller 42 is inclined with respect to the radial direction of the rolled web 2 to be packaged, which radial direction intersects perpendicularly to the direction along which the wrapping material 4 is fed. (Stated differently, the axis of rotation l1 of the feed roller 42 is inclined with respect to the direction of the straight line connecting the point O and the point P, at which the wrapping material 4 begins to be wound around the outer circumferential portion of the rolled web 2 to be packaged.) Specifically, the axis of rotation l1 of the feed roller 42 is inclined such that the outer periphery of the axis of rotation l1, which outer periphery is taken in the radial direction of the rolled web 2 to be packaged, is more forward with respect to the direction, along which the wrapping material 4 is fed, than the inner periphery of the axis of rotation l1, which inner periphery is taken in the radial direction of the rolled web 2 to be packaged. The feed roller 42 is rotated while it is being in contact with the side edge part 4*a* of the wrapping material 4. The side edge part 4*a* of the wrapping material 4 is thereby fed while the side edge part 4*a* is being imparted with tension towards the center of rotation of the rolled web 2 to be packaged.

Figure 3A:
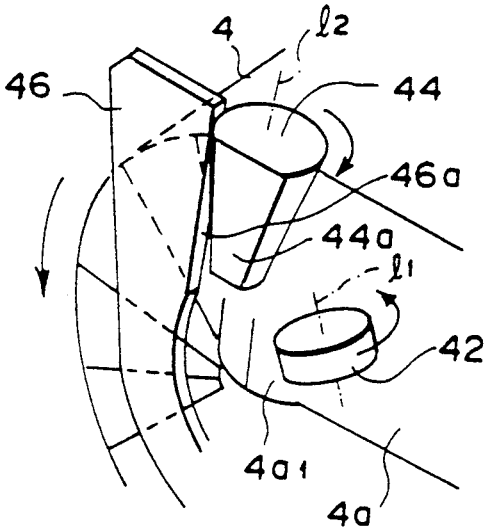
Figure 3B:
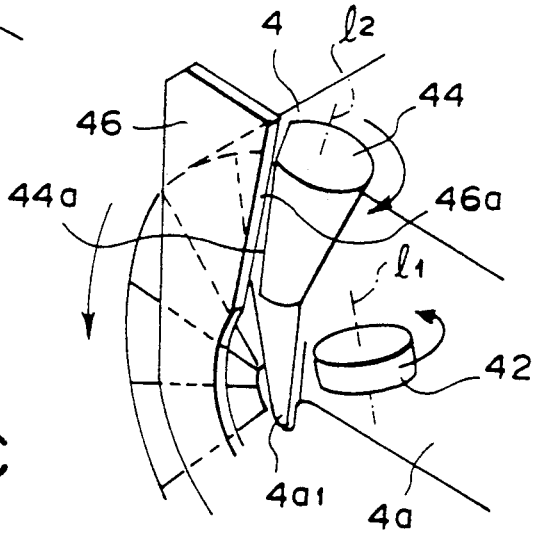
Figure 3C:
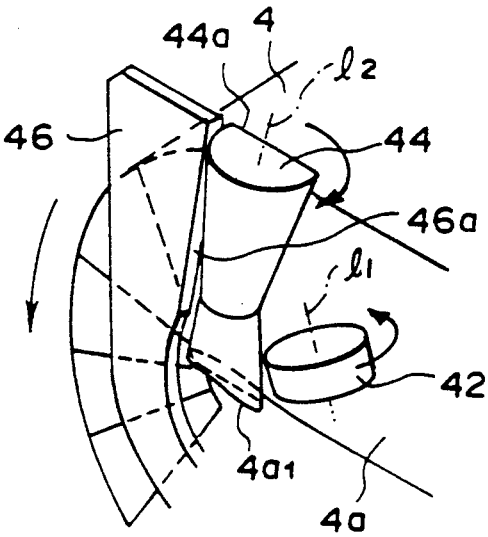

As illustrated in FIGS. 3A, 3B, and 3C, a folding member 44 is located on the side more forward than the feed roller 42 with respect to the direction, along which the wrapping material 4 is fed. The folding member 44 is supported such that the space between the folding member 44 and the opposed end faces of the rolled web 2 to be packaged varies periodically. A slack portion 4*a*1 of the side edge part 4*a* of the wrapping material 4 occurs on the side forward from the feed roller 42 with respect to the direction, along which the wrapping material 4 is fed. The slack portion 4*a*1 is folded by the folding member 44 at predetermined intervals onto the opposed end faces of the rolled web 2 to be packaged.

Reverting to FIG. 2, when part of the wrapping material 4 has passed through the point P, at which the wrapping material 4 begins to be wound around the outer circumferential portion of the rolled web 2 to be packaged, a difference in speed occurs between the inner circumferential portion and the outer circumferential portion of the side edge part 4*a* of the wrapping material 4. The slack portion 4*a*1 is caused to occur by such a difference in speed.

As illustrated in FIGS. 3A, 3B, and 3C, the folding member 44 rotates around an axis of rotation l2 in the direction indicated by the arrow, which direction is reverse to the direction along which the wrapping material 4 is fed. The axis of rotation l2 of the folding member 44 is inclined with respect to the radial direction of the rolled web 2 to be packaged, which radial direction intersects perpendicularly to the direction along which the wrapping material 4 is fed. Specifically, the axis of rotation l2 of the folding member 44 is inclined such that the outer periphery of the axis of rotation l2, which outer periphery is taken in the radial direction of the rolled web 2 to be packaged, is more rearward with respect to the direction, along which the wrapping material 4 is fed, than the inner periphery of the axis of rotation l2, which inner periphery is taken in the radial direction of the rolled web 2 to be packaged. The folding member 44 is constituted of a truncated cone having a cutaway part 44*a*, from which the circumferential part of the truncated cone has been cut away along the axis of rotation l2. When the folding member 44 is rotated, the cutaway part 44*a* periodically faces the opposed end faces of the rolled web 2 to be packaged.

A fold keeping plate 46 is located on the side more forward than the folding member 44 with respect to the direction, along which the wrapping material 4 is fed. The fold keeping plate 46 extends along and is spaced a predetermined distance from the opposed end faces of the rolled web 2 to be packaged. An edge face 46*a* of the fold keeping plate 46 should preferably be inclined in the same manner as that of the axis of rotation l2 of the folding member 44. Specifically, the edge face 46*a* of the fold keeping plate 46 should preferably be inclined with respect to the radial direction of the rolled web 2 to be packaged such that the outer part of the edge face 46*a*, which outer part is taken in the radial direction of the rolled web 2 to be packaged, is more rearward with respect to the direction, along which the wrapping material 4 is fed, than the inner part of the edge face 46*a*, which inner part is taken in the radial direction of the rolled web 2 to be packaged. (In FIG. 1, the angle of inclination of the edge face 46*a* with respect to the radial direction of the rolled web 2 to be packaged is indicated as $\theta 2$.) In general, folds of the side edge part 4*a* of the wrapping material 4, which have been formed, will easily become deformed in the region in the vicinity of the center of the rolled web 2 to be packaged. With this embodiment wherein the edge face 46*a* of the fold keeping plate 46 is inclined in the manner described above, parts of the folds of the side edge part 4*a* of the wrapping material 4, which parts are in the region in the vicinity of the center of the rolled web 2 to be packaged, can smoothly enter the space defined by the fold keeping plate 46. Therefore, such parts of the folds of the side edge part 4*a* of the wrapping material 4 do not become deformed.

As shown in FIG. 3A, after the side edge part 4*a* of the wrapping material 4 has passed over the feed roller 42, the slack portion 4*a*1 occurs in the side edge part 4*a*. The folding member 44 rotates in the direction reverse to the direction, along which the wrapping material 4 is fed, while the circumferential portion of the folding member 44 is being in contact with the side edge part 4*a*. Therefore, as shown in FIGS. 3B, and 3C, the slack portion 4*a*1 is folded into a predetermined shape. The axis of rotation l2 of the folding member 44 is inclined in the manner described above, Therefore,, the side edge part 4*a* of the wrapping material 4 is folded while the side edge part 4*a* is being imparted with tension towards the center of rotation of the rolled web 2 to be packaged. Also, as described above, the folding member 44 is constituted of the truncated cone. Therefoe, the circumferential speed of the folding member 44 on the outer part of the folding member 44, which outer part is taken in the radial direction of the rolled web 2 to be packaged, is higher than the circumferential speed of the folding member 44 on the inner part of the folding member 44, which inner part is taken in the radial direction of the rolled web 2 to be packaged. Accordingly, sufficiently large folding force can be given to the outer circumferential portion of the side edge part 4*a* of the wrapping material 4, at which portion large folding force is required. Also, small folding force can be given to the inner circumferential portion of the side edge part 4*a* of the wrapping material 4, which portion does not require large folding force and is readily adversely affected by the reverse rotation of the folding member 44.

(In cases where no adverse effects occur from the reverse rotation of the folding member 44, the folding member 44 may be constituted in a columnar shape.)

Additionally, the folding member 44 has the cutaway part 44*a*. Therefore, when the folding member 44 rotates, the space between the folding member 44 and the opposed end faces of the rolled web 2 to be packaged varies periodically. As shown in FIG. 3C, the folding member 44 is rotated such that the cutaway part 44*a* faces the opposed end faces of the rolled web 2, which is to be packaged, with the timing with which a fold of the slack portion 4*a*1 is formed and the side edge part 4*a* becomes thick. Therefore, the fold, which has been formed and at which the side edge part 4*a* has become thick, can easily pass through the space formed between the cutaway part 44*a* and the opposed end faces of the rolled web 2 to be packaged. In this manner, each time the folding member 44 rotates one turn, a fold of the wrapping material 4 is regularly formed on the opposed end faces of the rolled web 2 to be packaged.

Figure 4A:
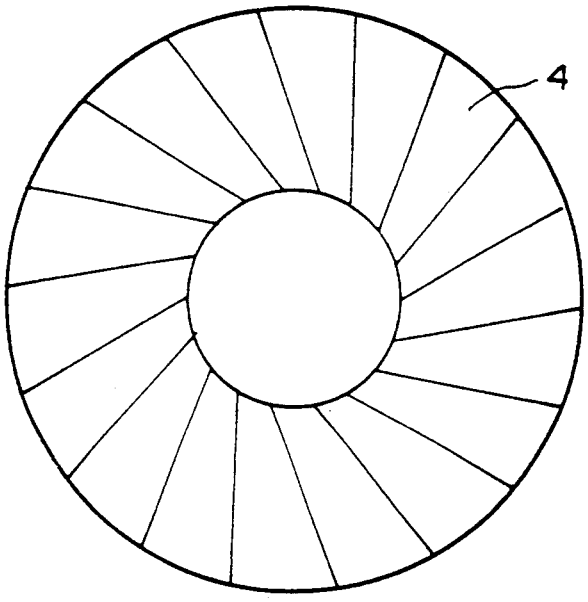
Figure 4B:
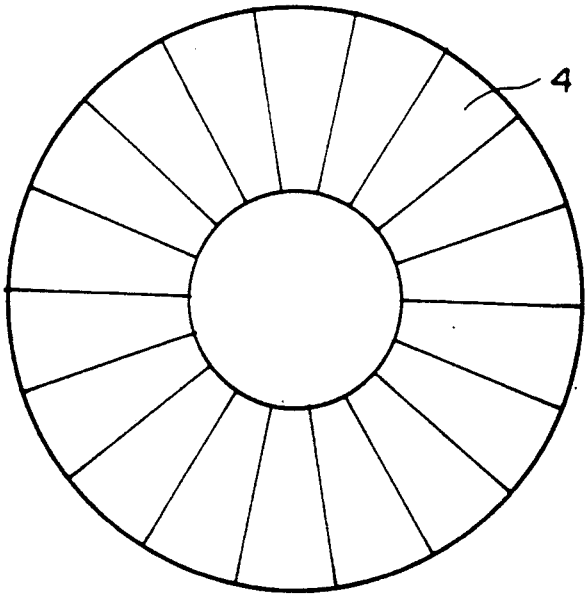
Figure 6A:
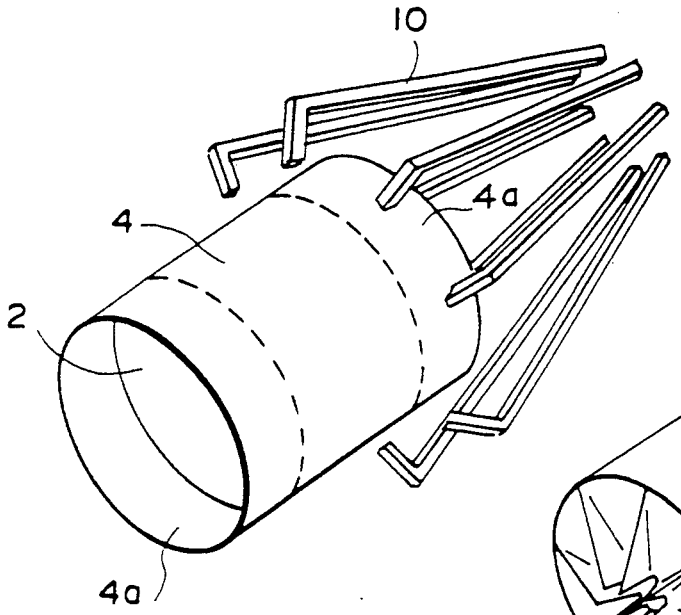
FIG. 6A PRIOR ART
FIGS. 6A and 6B are perspective views showing a conventional apparatus for packaging a rolled web.
Figure 6B:
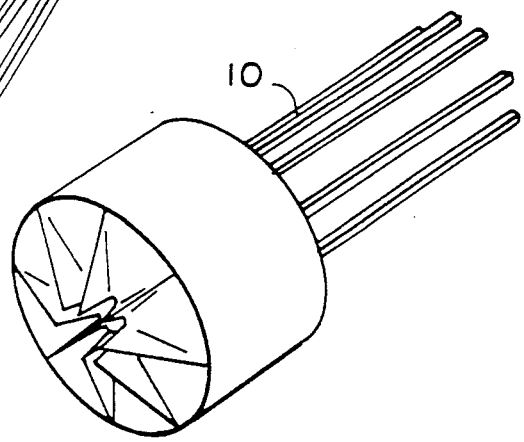
FIG. 6B PRIOR ART
Figure 7:
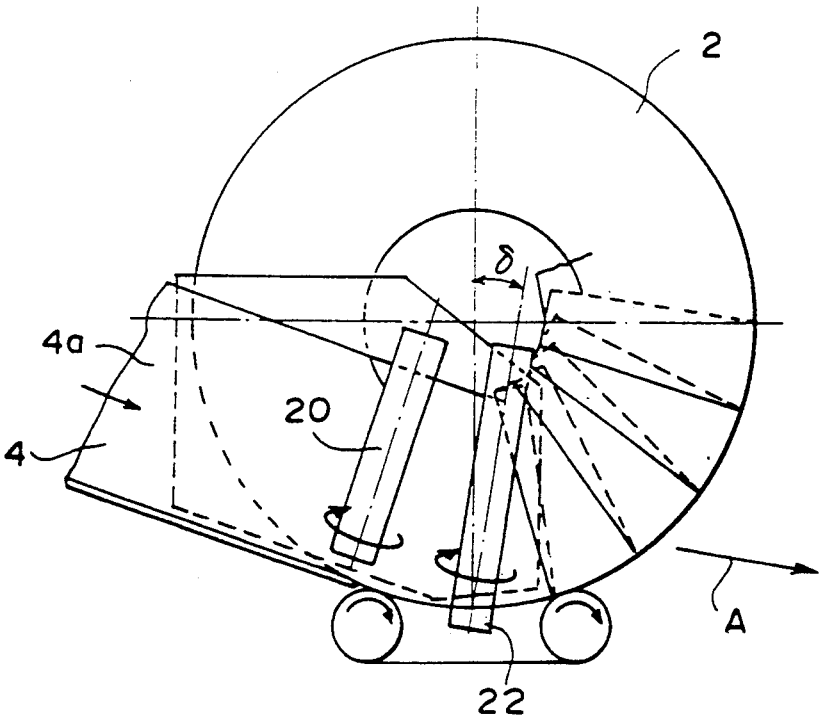
FIG. 7 PRIOR ART
FIG. 7 is a side view showing a different conventional apparatus for packaging a rolled web.

In cases where folds are formed as shown in FIG. 6B such that the ridges of the folds extend in the radial direction of the rolled web 2 to be packaged, when the folds are pressed onto the opposed end faces of the rolled web 2 to be packaged, the ridges of the folds incline from the radial direction of the rolled web 2 to be packaged. Therefore, as shown in FIG. 4A, folds are obtained in a spiral pattern. In such cases, the width of the side edge part 4*a* of the wrapping material 4, which width is necessary for covering the opposed end faces of the rolled web 2 to be packaged, cannot be kept small. On the other hand, with the aforesaid embodiment, the axis of rotation l2 of the folding member 44 is inclined in the manner described above with respect to the radial direction of the rolled web 2 to be packaged. Therefore, with the aforesaid embodiment, as shown in FIG. 4B, radial folds can be obtained.

The folding member 44 is located in the vicinity of the point P, at which the wrapping material 4 begins to be wound around the outer circumferential portion of the rolled web 2 to be packaged. Such that the slack portion 4*a*1 of the side edge part 4*a* may be formed easily, the folding member 44 should preferably be located on the side more forward with respect to the direction, along which the wrapping material 4 is fed, than the point P, at which the wrapping material 4 begins to be wound around the outer circumferential portion of the rolled web 2 to be packaged. The folding member 44 should more preferably be located such that the point, at which the folding member 44 faces the outer circumferential edge of the opposed end faces of the rolled web 2 to be packaged, is spaced a distance equal to the size of a single fold forwardly with respect to the direction, along which the wrapping material 4 is fed, from the point P, at which the wrapping material 4 begins to be wound around the outer circumferential portion of the rolled web 2 to be packaged. In such cases, at the instant at which the wrapping material 4 has been slackened by a length equal to the size of a single fold, the resulting slack portion of the wrapping material 4 can be folded onto the opposed end faces of the rolled web 2 to be packaged.

The drive rollers 32, 32 and the feed roller 42 are rotated in synchronization with each other such that the wrapping material 4 may be fed at a predetermined speed. The period with which the folding member 44 is rotated may be selected arbitrarily, and any desired number of folds can thereby be obtained. The folding member 44 is constituted of a material, such as a plastic material, when exhibits small force of friction with respect to the wrapping material 4. Also, the feed roller 42 is constituted of a material, such as rubber, which exhibits large force of friction with respect to the wrapping material 4.

The folds, which have been formed by the folding member 44, are prevented by the fold keeping plate 46 from rising from the opposed end faces of the rolled web 2 to be packaged. The fold keeping plate 46 need not necessarily cover the whole area of the opposed end faces of the rolled web 2, which is to be packaged, but may extend over an arbitrary width, which is taken in the circumferential direction of the rolled web 2 to be packaged. In this embodiment, no mechanism for the folding in the chrysanthemum-like pattern need be located around a core 2*a* of the rolled web 2 to be packaged. Therefore, the region around the core 2*a* of the rolled web 2 to be packaged can be kept uncovered. Accordingly, operations for fitting a cap, which fixes the folds of the wrapping material 4, and adhering a seal, or the like, can be carried out in the folding machine.

The feed roller 42, the folding member 44, the guide plate 40, and the fold keeping plate 46, which are located at each opposed end face of the rolled web 2 to be packaged, are combined into a single unit. When a rolled web 2 having a different width is to be packaged, the positions of the two units located on the opposed end faces of the rolled web 2 to be packaged are adjusted in the horizontal direction in accordance with the width of the rolled web 2 to be packaged. When a rolled web 2 having a different diameter is to be packaged, the center point of the rolled web 2 to be packaged is aligned with the center point O of the folding machine. The diameter of the rolled web 2 to be packaged may vary in such a range that the feed roller 42 and the folding member 44 may stand facing the opposed end faces of the rolled web 2 to be packaged.

As described above, with this embodiment, the feed roller 42 is located in the vicinity of each of the opposed end faces of the rolled web 2, which is to be packaged. The axis of rotation of the feed roller 42 is inclined with respect to the radial direction of the rolled web 2 to be packaged, which radial direction intersects perpendicularly to the direcction along which the wrapping material 4 is fed. Specifically, the axis of rotation of the feed roller 42 is inclined such that the outer periphery of the axis of rotation l1, which outer periphery is taken in the radial direction of the rolled web 2 to be packaged, is more forward with respect to the direction, along which the wrapping material 4 is fed, than the inner periphery of the axis of rotation l1, which inner periphery is taken in the radial direction of the rolled web 2 to be packaged. The feed roller 42 is rotated while it is being in contact with the side edge part 4*a* of the wrapping material 4. The side edge part 4*a* of the wrapping material 4 is thereby fed while the side edge part 4*a* is being imparted with tension towards the center of rotation of the rolled web 2 to be packaged. Therefore, the wrapping material 4 can be prevented from being pushed outwardly in the radial direction of a rolled web 2 to be packaged, and the side edge parts 4*a*, 4*a* of the wrapping material 4 can be folded accurately.

Also, with the aforesaid embodiment, the folding member 44 is located on the side more forward than the feed roller 42 with respect to the direction, along which the wrapping material 4 is fed. The folding member 44 is supported such that the space between the folding member 44 and the opposed end faces of the rolled web 2 to be packaged varies periodically. The slack portion 4i a1 of the side edge part 4*a* of the wrapping material 4, which slack portion occurs on the side forward from the feed roller 42 with respecct to the direction, along which the wrapping material 4 is fed, is folded by the folding member 44 at predetermined intervals onto the opposed end faces of the rolled web 2 to be packaged. Therefore, no problem occurs in that, as in the conventional techniques, the side edge part 4*a* of the wrapping material 4 cannot smoothly pass over a folding roller and a lag thereby occurs with the formation of the folds. Additionally, the sizes of the folds and the intervals between the folds can be prevented from fluctuating. Accordingly, with the aforesaid embodiment, folds of the side edge parts 4*a*, 4*a* of the wrapping material 4 can be formed regularly such that the folding speed may be kept high and the wrapping material 4 may not be broken or damaged.

Figure 5:
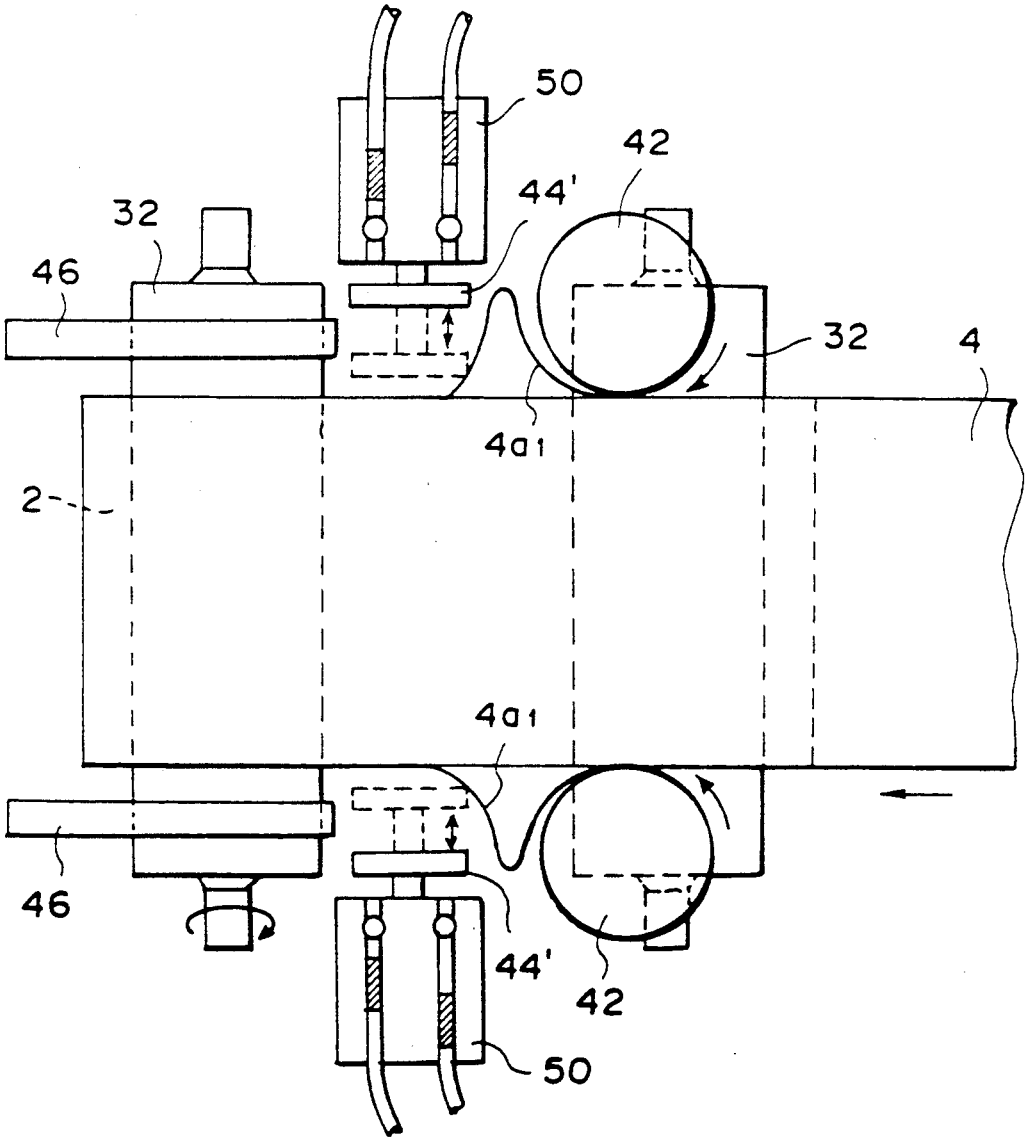
FIG. 5 is a plan view showing a different embodiment of the apparatus for packaging a rolled web in accordance with the present invention.

FIG. 5 is a plan view showing a different embodiment of the apparatus for packaging a rolled web in accordance with the present invention.

In this embodiment, each of folding members 44', 44' is constituted of a plate-like member, which can be moved by an air cylinder 50 reciprocally along the center axis of the rolled web 2 to be packaged. By controlling the air cylinder 50 with a control means (not shown), the space between the folding member 44' and the opposed end faces of the rolled web 2 to be packaged is changed periodically. In this manner, the slack portion 4*a*1 of the side edge part 4*a* of the wrapping material 4 is folded regularly.

In the embodiments described above, surface winding is carried out in the apparatus for packaging a rolled web. With the method for packaging a rolled web in accordance with the present invention, the folding member 44 or the folding member 44' is located at a position different from the position, at which the core 2*a* of the rolled web 2 to be packaged is located. Therefore, in cases where the side edge parts 4*a*, 4*a* of the wrapping material 4 do not interfere with the winding shaft, folds can also be formed in a chrysanthemum-like pattern with the axial winding technique. However, in such cases, the circumferential speed varies for different diameters of the rolled web 2 to be packaged, and therefore the folding member must be controlled in a slightly complicated manner.

What is claimed is:

1. A method for packaging a rolled web, wherein a leading edge part of a wrapping material having side edge parts, each of which has been bent into an L-shape from the middle part of the wrapping material, is brought onto part of the outer circumferential portion of a rolled web, which is to be packaged, such that the bent corners of the wrapping material are located at side edges of the outer circumferential portion of the roll to be packaged, and thereafter the roll to be packaged is rotated such that the wrapping material may be fed forwardly, whereby the wrapping material is wound around the outer circumferential portion of the roll to be packaged, wherein the improvement comprises the steps of:

i) locating a feed roller in the vicinity of each of opposed end faces of said roll, which is to be packaged, the axis of rotation of said feed roller being inclined with respect to the radial direction of said roll to be packaged, which radial direction intersects perpendicularly to the direction along which said wrapping material is fed, such that the outer periphery of said axis of rotation, which outer periphery is taken in said radial direction of said roll to be packaged, is more forward with respect to the direction, along which said wrapping material is fed, than the inner periphery of said axis of rotation, which inner periphery is taken in said radial direction of said roll to be packaged, ii) locating a folding member on the side more forward than said feed roller with respect to the direction, along which said wrapping material is fed, said folding member being supported such that the space between said folding member and the opposed end faces of said roll to be packaged varies periodically, iii) rotating said feed roller while it is being in contact with the side edge part of said wrapping material, said side edge part wrapping material being thereby fed while said side edge part is being imparted with tension towards the center of rotation of said roll to be packaged, and iv) folding a slack portion of said side edge part of said wrapping material, which slack portion occurs on the side forward from said feed roller with respect to the direction, along which said wrapping material is fed, by said folding member at predetermined intervals onto said opposed end faces of said roll to be packaged.

2. A method as defined in claim 1 wherein said folding member is constituted of a folding roller having its axis of rotation inclined with respect to the radial direction of said roll to be packaged, which radial direction intersects perpendicularly to the direction along which said wrapping material is fed, such that the outer periphery of said axis of rotation, which outer periphery is taken in said radial direction of said roll to be packaged, is more rearward with respect to the direction, along which said wrapping material is fed, than the inner periphery of said axis of rotation, which inner periphery is taken in said radial direction of said roll to be packaged, said folding roller having a cutaway part, from which the circumferential part of said folding roller has been cut away along said axis of rotation of said folding roller, and being rotated in the direction reverse to the direction along which said wrapping material is fed.

3. A method as defined in claim 1 wherein the folding by said folding member is carried out on the side more forward with respect to the direction, along which said wrapping material is fed, than a point, at which said wrapping material begins to be wound around the outer circumferential portion of said roll to be packaged.

4. An apparatus for packaging a rolled web, wherein a leading part of a wrapping material having side edge parts, each of which has been folded into an L-shape from the middle part of the wrapping material, is brought onto part of the outer circumferential portion of a rolled web, which is to be packaged, such that the bent corners of the wrapping material are located at side edges of the outer circumferential portion of the roll to be packaged, and thereafter the roll to be packaged is rotated such that the wrapping material may be fed forwardly, whereby the wrapping material is wound around the outer circumferential portion of the roll to be packaged, wherein the improvement comprises the provision of:

i) a feed roller located in the vicinity of each of opposed end faces of said roll, which is to be packaged, the axis of rotation of said feed roller being inclined with respect to the radial direction of said roll to be packaged, which radial direction intersects perpendicularly to the direction along which said wrapping material is fed, such that the outer periphery of said axis of rotation, which outer periphery is taken in said radial direction of said roll to be packaged, is more forward with respect to the direction, along which said wrapping material is fed, than the inner periphery of said axis of rotation, which inner periphery is taken in said radial direction of said roll to be packaged, said feed roller being rotated while it is being in contact with the side edge part of said wrapping material, said side edge part of said wrapping material being thereby fed in the direction, along which said roll to be packaged rotates, while said side edge part is being imparted with tension towards the center of rotation of said roll to be packaged, thereby producing a slack portion on said side edge part, which occurs on the side forward from said feed roller with respect to the direction along which said wrapping member is fed, and ii) a folding member located on the side more forward than said feed roller with respect to the direction, along which said wrapping material is fed, for folding said slack portion at predetermined intervals onto said opposed end faces of said roll to be packaged, said folding member being supported such that the space between said folding member and the opposed end faces of said roll to be packaged varies periodically.

5. An apparatus as defined in claim 4 wherein said folding member is constituted of a folding roller having its axis of rotation inclined with respect to the radial direction of said roll to be packaged, which radial direction intersects perpendicularly to the direction along which said wrapping material is fed, such that the outer periphery of said axis of rotation, which outer periphery is taken in said radial direction of said roll to be packaged, is more rearward with respect to the direction, along which said wrapping material is fed, than the inner periphery of said axis of rotation, which inner periphery is taken in said radial direction of said roll to be packaged, said folding roller having a cutaway part, from which the circumferential part of said folding roller has been cut away along said axis of rotation of said folding roller, and being rotated in the direction reverse to the direction along which said wrapping material is fed.

6. An apparatus as defined in claim 4 wherein the folding by said folding member is carried out on the side more forward with respect to the direction, along which said wrapping material is fed, than a point, at which said wrapping material begins to be wound around the outer circumferential portion of said roll to be packaged.

* * * * *